US008022577B2

(12) United States Patent
Grice

(10) Patent No.: US 8,022,577 B2
(45) Date of Patent: Sep. 20, 2011

(54) THREE-WAY AND FOUR-WAY SWITCHING CIRCUIT

(75) Inventor: Gordon T. Grice, Issaquah, WA (US)

(73) Assignee: Echelon Corporation, San Jose, CA (US)

( * ) Notice: Subject to any disclaimer, the term of this patent is extended or adjusted under 35 U.S.C. 154(b) by 0 days.

(21) Appl. No.: 12/286,574

(22) Filed: Sep. 30, 2008

(65) Prior Publication Data

US 2010/0079006 A1 Apr. 1, 2010

(51) Int. Cl.

| | |
|---|---|
| ***H01H 19/64*** | (2006.01) |
| ***H01H 31/10*** | (2006.01) |
| ***H01H 33/52*** | (2006.01) |
| ***H01H 33/59*** | (2006.01) |
| ***H01H 47/00*** | (2006.01) |
| ***H01H 85/46*** | (2006.01) |

(52) U.S. Cl. ..... 307/114; 307/112; 307/113; 307/115; 307/116; 307/125; 307/131

(58) Field of Classification Search ..... 307/114
See application file for complete search history.

(56) References Cited

U.S. PATENT DOCUMENTS

| | | | | |
|---|---|---|---|---|
| 3,119,046 | A * | 1/1964 | Usher | 315/129 |
| 4,377,754 | A * | 3/1983 | Thompson | 307/114 |
| 4,739,187 | A * | 4/1988 | Nelson et al. | 307/118 |
| 4,885,654 | A * | 12/1989 | Budyko et al. | 361/13 |
| 4,918,690 | A | 4/1990 | Markkula, Jr. et al. | |
| 6,710,553 | B2 * | 3/2004 | Logan | 315/291 |
| 7,227,341 | B2 | 6/2007 | Downey et al. | |
| 2006/0158171 | A1 * | 7/2006 | Downey et al. | 323/319 |
| 2007/0007826 | A1 * | 1/2007 | Mosebrook et al. | 307/139 |
| 2007/0018506 | A1 * | 1/2007 | Paik et al. | 307/115 |
| 2007/0159153 | A1 * | 7/2007 | Fricke et al. | 323/288 |
| 2008/0258563 | A1 * | 10/2008 | Hodges | 307/112 |

* cited by examiner

*Primary Examiner* — Rexford Barnie
*Assistant Examiner* — Justen Fauth
(74) *Attorney, Agent, or Firm* — Blakely, Sokoloff, Taylor & Zafman LLP

(57) ABSTRACT

A three-way or four-way switching circuit for lighting, and the like, is described. One three-way switch is replaced with an electronic switch. Both legs of the switching circuit are powered all the time and current is sensed in the legs to determine when one of the three-way or four-way switches has been switched. This information is used to turn the light on and off.

9 Claims, 1 Drawing Sheet

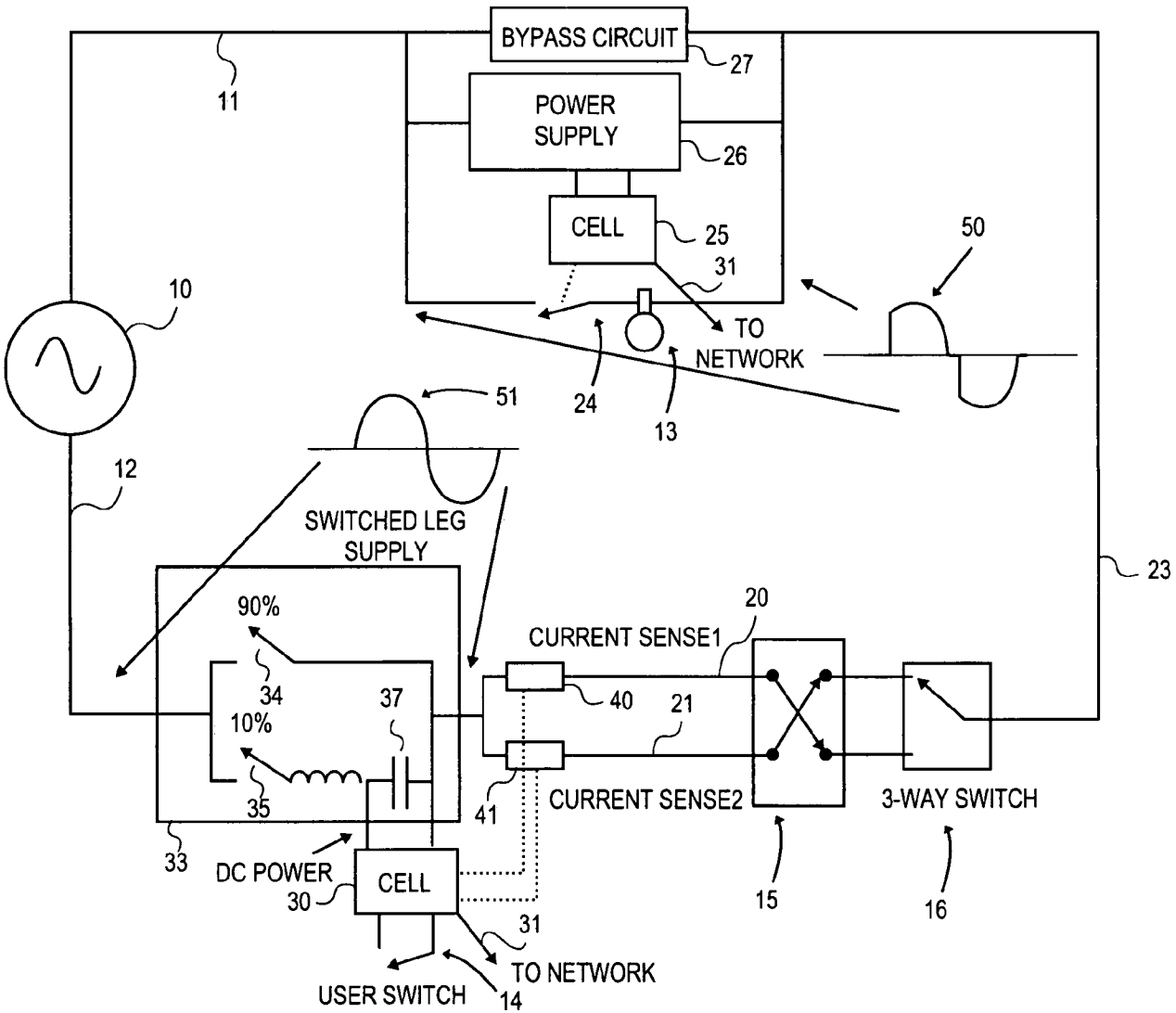
BYPASS CIRCUIT
POWER SUPPLY
CELL
TO NETWORK
SWITCHED LEG SUPPLY
CURRENT SENSE1
CURRENT SENSE2
3-WAY SWITCH
TO NETWORK
USER SWITCH
DC POWER
90%
10%
10
11
12
13
14
15
16
20
21
23
24
25
26
27
30
31
33
34
35
37
40
41
50
51

THREE-WAY AND FOUR-WAY SWITCHING CIRCUIT

FIELD OF THE INVENTION

The invention relates to three-way and four-way switching circuits.

PRIOR ART AND RELATED ART

Most three-way and four-way switching circuits, particularly for lighting, use parallel wiring legs between switches to receive on and off inputs from any one of the switches. In a three-way switching arrangement, two single pole, double throw (SPDT) switches have power at all times in one of the two legs. In four-way switching, one or more four-way switches (double pole, double throw (DPDT) switches) are added in the parallel legs to further allow switching from one leg to the other.

Three-way and four-way switching circuits do not readily lend themselves to improvements used in lighting circuits having a single pole, single throw (SPST) switch. Dimmers and electronically operated switches operating in networks, are among improvements not readily adaptable to three-way and four-way circuits.

One system for controlling lighting, as well as other loads, is sold by Echelon Corporation under the trademark LON® (described, in part, in U.S. Pat. No. 4,918,690). Intelligent cells communicate among themselves through power line communications, radio frequency communications, infrared or a wired network (such as a twisted pair) to control lighting switches. For three-way and four-way lighting, a cell and switch replace each of the three-way and four-way switches thereby providing the same functionality. This however, requires changing each of the switches when an existing lighting circuit is upgraded.

An additional problem arises when providing network-like switching at switch locations only having the switched leg or legs. Since there is no neutral power line run to these locations, providing current in a switched leg to power a network device such as a cell, requires a somewhat special power supply which operates from a switched leg. This problem and a power supply for operating from a switched leg, as well as other improvements, are described in U.S. Pat. No. 7,227,341.

In general, the switched leg power supply "steals" power from the switched leg by momentarily closing the circuit for the light (or other load) when the light is off. A small amount of current is stored for each AC half cycle to power a cell or the like. When the light is on, the light is momentarily turned off to divert power which is again stored to operate the cell. These operations do not cause either noticeable illumination of a typical incandescent bulb when the bulb is off or a significant diminishing of the light's intensity when the light is on. When the bulb is burnt out, 240 volts AC is used, or for sources of illumination using electronic or magnetic ballast "stealing" of power becomes more problematical. U.S. Pat. No. 7,227,341 describes a bypass circuit placed across the light which provides a relatively low impedance during the beginning of each AC half cycle, and a relatively high impedance during the remainder of the AC half cycle. This allows a power supply operating at a switch to draw power from the switched leg even under these more challenging conditions.

As will be seen, the present invention allows the incorporation of network switching into a three-way or four-way switching circuit without the need to change all the switches or to rewire the circuit.

SUMMARY OF THE INVENTION

A method for controlling a load in a three-way or four-way switching circuit having two legs associated with the three-way or four-way circuit is disclosed. Both legs of the three-way or four-way circuit are coupled to a source of power such that both legs are always "hot." The current in at least one of the legs is sensed. Some current flow occurs through this circuit even when the load is off, for instance the current associated with a switched leg power supply. When the current flow changes from one leg to the other, the load is turned from off-to-on or on-to-off by a network controlled switch.

BRIEF DESCRIPTION OF THE DRAWINGS

The FIGURE is an electrical diagram showing an embodiment of the present invention.

DETAILED DESCRIPTION

In the following description, numerous specific details are set forth to provide a thorough understanding of the present invention. In other instances, known circuits have not been set forth in detail, such as the circuits shown in U.S. Pat. No. 7,227,341, in order not to unnecessarily obscure the present invention. It will be apparent that the present invention may be practiced without these specific details.

The controlling of a light in a three-way or four-way switching circuit is described in the following description. It will be apparent to one skilled in the art that other loads (e.g. fan, heater) may be controlled with the present invention.

Referring now to the FIGURE, a source of AC power 10 is shown which may be an ordinary connection to a 50 cycle or 60 cycle, 110/220 electrical power network. For purposes of discussion, it is assumed that line 11 is the neutral line (e.g. white line in a 110 volt system), and line 12 is the hot line in such a system (e.g. black or red line). The circuit includes a light 13, a manual SPST switch 14 for turning the light on or off, a four-way (DPDT) switch 15, and a three-way (SPDT) switch 16.

By way of example, the circuit in the FIGURE may be an upgraded, ordinary four-way switching circuit originally having two three-way switches and one four-way switch. Switch 14, and the other circuitry associated with the switch 14, replaced one of the three-way switches. Additional circuitry has been added to the light 13, as will be discussed. The four-way switch 15 and three-way switch 16 remain from the original circuit and, switching either of them turns the light from either on-to-off or off-to-on even though the function of the switches is different from their function in an ordinary three-way or four-way switching circuit.

A three-way switching circuit typically has two three-way switches, additional four-way switches are added between the three-way switches, such as switch 15. As described below, the four-way switches 15 are optional, and their presence or absence in the circuit of the FIGURE does not change the circuit's operation.

In the FIGURE, one of the three-way switches, as mentioned, has been replaced with a circuit which, among other things, connects the legs 20 and 21 to line 12 so that the legs of the switched leg circuit are, for the most part, coupled to line 12. Thus, both lines 20 and 21 are "hot" except for a small part of the AC cycle no matter whether the light 13 is on or off. This is a departure from an ordinary three-way and four-way switching circuits. Since lines 20 and 21 are always receiving power, line 23 is also always "hot." It is the electronic switch 24 under control of the cell 25 which actually turns the light on or off.

Two cells, 25 and 30, which may be Neuron® cells from Echelon Corporation communicate with one another, as shown by lines 31. Communications may occur either over a power line, through radio frequency communications, or through a network line such as a twisted pair. The cell 25 opens and closes the switch 24 based on messages it receives over the network 31. The open or closed state of manual switch 14 is sensed by the cell 30.

Both the cells 25 and 30 require power to operate. Since as mentioned, there is power substantially all of the time on line 23, an ordinary power supply 26 may be used to provide DC power to the cell 25. Note the power supply 26 is disposed between lines 23 and 11, and thus, there is a potential across it at all times, except as will be seen at the very beginning of each AC half-cycle.

A switched leg power supply is used for cell 30 because this cell is in a switched leg. Such supplies are known in the prior art, for example see U.S. Pat. Nos. 4,713,598 and 6,043,635; additionally, see U.S. Pat. No. 7,227,341, circuit 10 of FIG. 1.

A switched leg power supply 33 shown in the FIGURE, provides power to the cell 30. As described in detail in the above-referenced patents, a control circuit closes the switch 35 at the beginning of each AC half cycle for a short period of time (e.g. 10% of the half cycle while the switch 34 is open). When the switch 35 is closed, current flows through the inductor 36 and charged onto the capacitor 37. The inductor and capacitor store power used by the cell 30. (A regulator not shown may be used to regulate the power for the cell 30.) For the greater part of each AC cycle (e.g. 90%) the switch 34 is closed and the switch 35 is open, allowing power to be applied to both lines 20 and 21. Consequently, for the majority of the time, both lines 20 and 21 receive power as does the circuits associated with the light 13.

The current is sensed in at least one of the legs 20 and 21. For purposes of explanation, two current sensors 40 and 41 in legs 20 and 21, respectively, are shown. These determine the leg in which current is flowing. A single sensor will serve this purpose where the cell 30 makes the logical conclusion that if current, for instance, is not flowing in leg 20, it must be flowing in leg 21. Thus, a single sensor in leg 20 or leg 21 is all that is needed.

The current sensors 40 and 41 may each be a low resistance shunt resistor and an amplifier to measure the voltage across the resistor. Other types of current sensing can be used such as current transformers. The cell 10 receives the output from the current sensors to determine when current changes from one leg to the other. The current sensors have a wide dynamic range and can sense not only the larger current flowing through the light 13 when the light is on, but also the current flowing through the power supply 26 or bypass circuit 27, when the light 13 is off.

As mentioned earlier, the light 13 is turned on or off through a switch 24 controlled by cell 25. The cell 25 receives power from an ordinary power supply 26. A bypass circuit 27 may also be used, such as the circuit 12 shown in FIG. 1 of U.S. Pat. No. 7,227,341. This circuit guarantees up to, for instance, 750 mAmps of a full AC cycle for the switched leg power supply 33. The power supply 26 sees the waveform 50. The relatively small missing portions of the waveform at the beginning of each AC half cycle do not affect the operation and power supply 26. In contrast, the switched leg supply sees a full sine wave for up to 750 mAmps of current as shown by waveform 51.

In operation, the cell 25 toggles the switch 24 any time the user switch 14 changes state, or any time current is sensed changing from one of the legs 20 and 21, to the other leg.

Assume for instance that the light 13 is on (switch 24 closed). Further assume that, because of the position of switches 15 and 16, current is being supplied to the light through the leg 20. If either switch 15 or 16 is switched, the current supplied to the light will change from leg 20 to 21. Whether there is a single or two current sensors, this condition is noted by the cell 30. A message is sent to the cell 25 via the network, which instructs cell 25 to toggle the switch 24. In this case, since the switch is closed, cell 25 opens the switch 24. Once the switch is opened, current is still sensed in line 21, albeit a lower current associated with the power supplies. Now if for example, switch 14 is closed, another message is sent via the network to cell 25 by the cell 30, causing the cell 25 to toggle switch 24, this time to close the switch 24. Current is still flowing in the leg 21; however, the state of the switch 14 is used by the cell 25 as a command to change the state of switch 24, just as it would do if the current changed from one leg to another.

One advantage to the circuit of the FIGURE is that pre-existing switches 15 and 16 may be used, without rewiring. While these switches do not directly open or close a circuit providing power to the light 13, nonetheless, the same effect is achieved. The cell 30, through the current sensors, senses the change of state of one of the switches, thereby causing the switch 24 to change state. Similarly, the user switch 14 albeit a single pole, single throw switch, acts as a three-way switch since the cell 30 detects whether the switch is opened or closed, and uses this to toggle the switch 24 through the network connection between the cells 30 and 25.

While not shown in the FIGURE, the cells, particularly cell 25, may receive commands from yet other cells, for instance, it can receive a command to turn off the light 13 (open switch 24) where, for instance, lighting is being shut off in areas of a home or factory from a main control.

While a simple single pole, single throw user switch 14 is shown in the FIGURE, a more complex control such as a dimmer may be used.

Thus, a circuit has been described which allows network-like switching in a three-way or four-way switching circuit, without requiring replacement of all the three-way and four-way switches.

What is claimed is:

1. A method for controlling a load in an AC three-way or four-way switching circuit having two legs associated with three-way or four-way switches, comprising:

coupling a cell and power supply for the cell across the load to control power to the load;

coupling both legs of a three-way or four-way switch to a source of power such that both legs receive power during a substantial portion of each AC half cycle;

providing some current flow through the switching circuit even when the load is off;

sensing current in at least one of the legs; and turning the load from off-to-on or on-to-off by sending a signal to the cell when current changes from one leg to the other.

2. The method defined by claim 1, wherein the load is a light, and wherein the current provided through the circuit when the light is off, is low enough to prevent noticeable illumination of the light.

3. The method defined by claim 1, wherein the current provided through the circuit when the light is off, flows only during the beginning of each AC half cycle.

4. A method for controlling a load in an AC three-way or four-way switching circuit having two legs, comprising:

coupling a cell across the load to control power to the load;

coupling the two legs of the switching circuit to a source of power used by the load such that both legs are coupled to receive power during a substantial portion of each AC cycle, independent of whether the load is on or off;

providing a current bypass across the load;

sensing current in at least one of the legs; and toggling the state of the load from on-to-off or off-to-on by the cell when a change of the sensed current occurs in one of the legs.

5. The method defined by claim 4, wherein the providing of the current bypass across the load comprises:

providing a first impedance across the load when the AC cycle is in a first range; and providing a second impedance across the load when the AC cycle is in a second range, the second impedance being greater than the first impedance, wherein the first range is a relatively brief range compared to the AC cycle with the second range occupying most of the AC cycle.

6. The method defined by claim 4, wherein the toggling step includes transmitting a message to the cell responsive to the changing of the sensed current from one leg to the other.

7. An apparatus for replacing a three-way switch in a three-way or four-way lighting circuit having a light, where the switch receives an AC power line signal and two switched legs comprising:

a first cell coupled across the light for tuning the light on and off;

a power supply coupled across the light for providing power to the cell;

a connection for coupling the power line to both legs for most of an AC cycle;

at least one current sensor for sensing the current in at least one of the legs; and a second cell coupled to the current sensor for sending a signal to the first cell in response to current change in one of the legs.

8. The apparatus defined by claim 7, including a manual switch, the second cell for detecting the state of the manual switch.

9. The apparatus defined by claim 8, including a switched leg power supply for providing power to the second cell.

* * * * *